175-48 SR
7/13/76 OR 3,968,844

175/50
3/30/78

United States Patent [19]

Walther, Jr. et al.

[11] 3,968,844

[45] July 13, 1976

[54] DETERMINING THE EXTENT OF ENTRY OF FLUIDS INTO A BOREHOLE DURING DRILLING

[75] Inventors: Herbert C. Walther, Jr., Ponca City, Okla.; George M. Myers, Houston, Tex.

[73] Assignee: Continental Oil Company, Ponca City, Okla.

[22] Filed: Sept. 19, 1974

[21] Appl. No.: 507,320

[52] U.S. Cl. ..... 175/48; 166/67; 166/224 R; 73/155

[51] Int. Cl.[2] ..... E21B 47/00

[58] Field of Search ..... 175/318, 48, 50, 235, 175/25, 72; 166/67, 224 R; 73/153, 155

[56] References Cited

UNITED STATES PATENTS

| | | | |
|---|---|---|---|
| 1,854,208 | 4/1932 | Lynch et al. | 175/48 X |
| 1,918,096 | 7/1933 | Greve | 175/318 X |
| 2,290,408 | 7/1942 | Crites | 175/48 X |
| 2,340,993 | 2/1944 | Smith | 175/48 X |
| 3,498,393 | 3/1970 | West et al. | 175/48 |
| 3,517,553 | 6/1970 | Williams et al. | 175/50 |
| 3,627,065 | 12/1971 | Murphy | 175/48 |

*Primary Examiner*—Ernest R. Purser
*Assistant Examiner*—Richard E. Favreau
*Attorney, Agent, or Firm*—Richard W. Collins

[57] ABSTRACT

A method for determining when formation fluids enter the borehole during drilling of a well wherein a bypass is provided in the drill string above the back pressure valve and the pressure at the surface downstream of the mud pump is determined.

4 Claims, 3 Drawing Figures

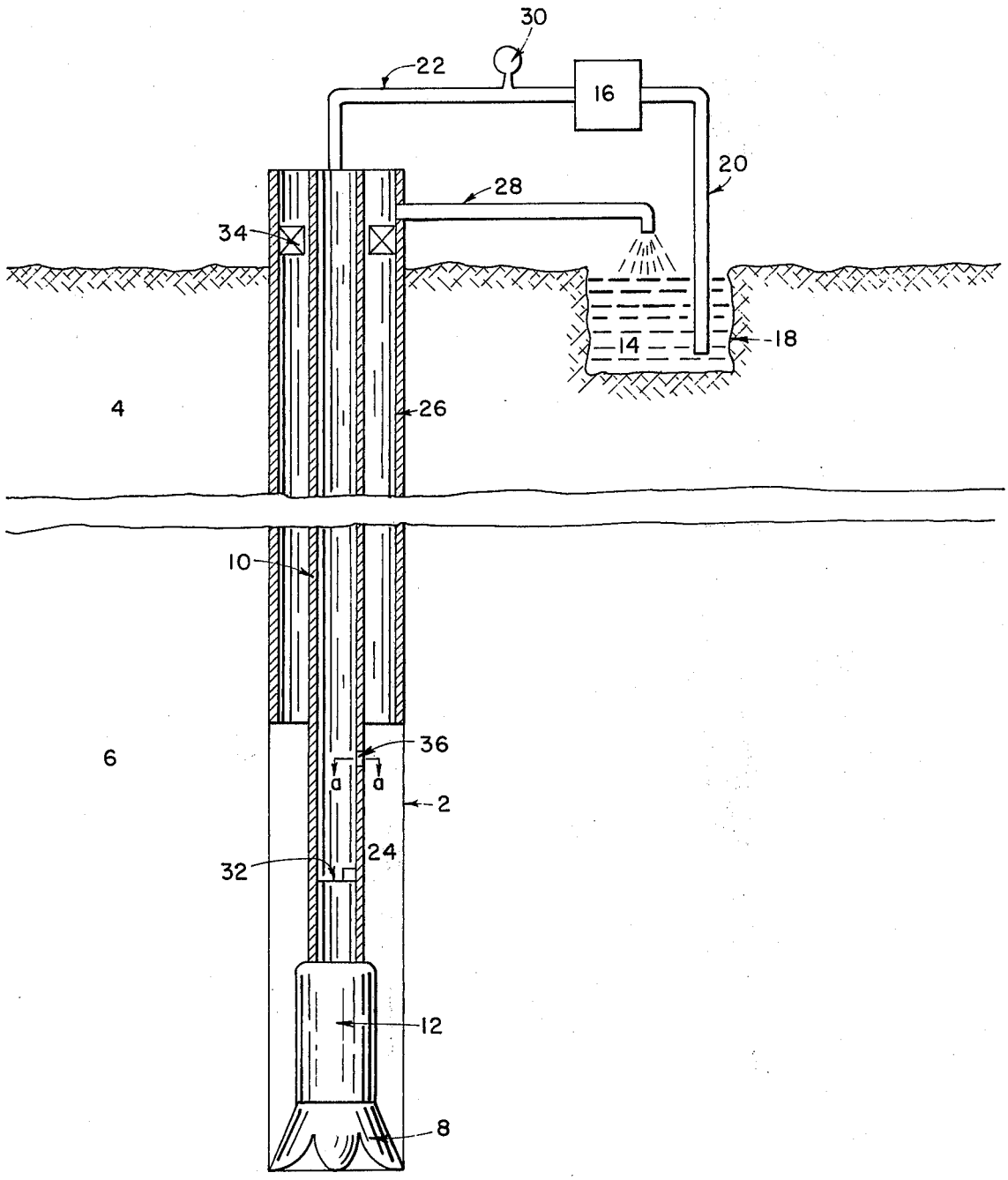
FIGURE I

DETERMINING THE EXTENT OF ENTRY OF FLUIDS INTO A BOREHOLE DURING DRILLING

BACKGROUND OF THE INVENTION

1. Field of the Invention

This invention relates to a method for the early detection of potential blowout conditions during the drilling of a well. More particularly, this invention relates to such a method to determine when fluid from a subterranean formation enters the borehole of a well being drilled using a circulating drilling fluid.

2. Description of the Prior Art

In drilling wells it is common practice to circulate a drilling fluid past the drill bit to cool the bit and help carry cuttings out of the borehole to the surface of the well. It is an important consideration during drilling to keep the pressure exerted on the wellbore by the drilling fluid substantially balanced against the pressure of the formation being drilled into. If the pressure of the drilling fluid becomes considerably less than the pressure of the formation, there is danger that there will be a blowout with fluids from the formation blowing to the surface, disrupting circulation of the drilling fluid, interrupting drilling operations and sometimes resulting in loss of the well. The pressure to be expected in formations usually increases with depth in a manner which can be approximately calculated. However in many sections of the world abnormally pressured formations are encountered during drilling wherein the pressure in a strata is either sharply lower or sharply higher than would be expected. If the pressure of the formation fluid becomes greater than the pressure of the drilling fluid, formation fluid will tend to flow into the wellbore. Generally this formation fluid will have a lower density than the drilling fluid, especially if it consists of or contains a gas. Thus the imbalance between the pressure exerted by the drilling fluid, now contaminated with a relatively low density fluid, and that exerted by the formation fluid increases sharply and a blowout may result.

It is evident that it is desirable to know as soon as possible when formation fluids begin to enter the wellbore so that remedial action may be taken, such as increasing the pressure of the drilling fluid as by increasing its density. Various attempts to solve this problem have been proposed in the past. A flapper valve has been installed in a flow line to indicate changes in flow rate. Magnetic flow meters have been installed on both the standpipe and the flow line to detect differences between the in-going and the outcoming flow. Gauges have been installed on the mud pit to detect any changes in level of the mud pit. A pressure gauge has been placed at the surface in the line through which the drilling fluid is discharged from the well. None of these methods has proven to be entirely satisfactory.

It is an object of this invention to provide a method for detecting entry of formation fluids into the wellbore soon after the beginning of such entry.

It is another object to provide such a method to minimize danger of a blowout.

It is still another object to provide such a method which is operable even in wells containing a float or a back pressure valve in the tubing.

Other objects, advantages and features will be apparent from a consideration of the following description, drawings and claims.

BRIEF SUMMARY OF THE INVENTION

A method for determining when formation fluids enter the borehole of a well during drilling comprising:

a. providing a bypass in the sidewall of the drill string above the bypass valve in said drill string, b. momentarily stopping circulation of the drilling fluid past the drill bit, and c. observing the pressure in the drilling fluid system at the surface of the well downstream from the mud pump.

BRIEF DESCRIPTION OF THE DRAWINGS

FIG. 1 is a schematic elevational view, partially in section, of a well borehole during drilling wherein the method of the present invention is employed.

DESCRIPTION OF THE PREFERRED EMBODIMENT

Figure 3:
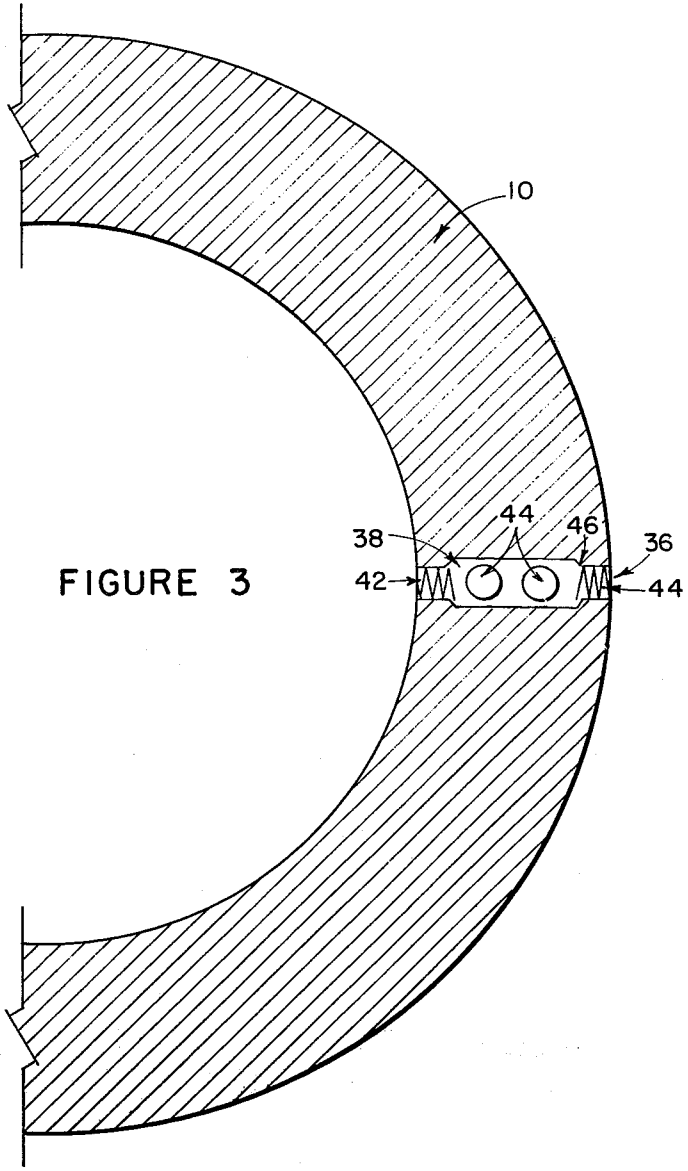
FIG. 3 is a sectional view taken along the line *a—a* in FIG. 1 depicting another embodiment of the bypass valve used in the process of this invention.

Referring now to FIG. 1, borehole 2 is drilled through earth strata 4 and 6 by drill bit 8 attached to sections of drill string 10 by collar 12. Drilling mud 14 is pumped by pump 16 from mud pit 18 down drill string 10 via lines 20 and 22, through drill bit 8, up annular space 24 between borehole 2 and drill string 10, the upper portion of which contains casing 26 and back into mud pit 18 via line 28. A sensitive pressure gauge 30 is positioned at the surface downstream of pump 16. During drilling of a well, a sufficient amount of cuttings are generated to increase the density of the drilling fluid in the annulus 24 to a value higher than the density of the drilling fluid in the drill string 10, such that the column of fluid in the annulus 24 is heavier and exerts a higher static pressure than the column of fluid in the drill string 10. As long as there is pressure communication between the annulus and the drill string, this difference in density is manifested as a pressure reading at gauge 30 when pump 16 is shut down. A back pressure valve 32 is positioned in drill string 10 near the bottom end thereof to prevent fluid from annulus 24 from backing up and entering drill string 10 when blowout preventer 34 is closed, and in order to maintain pressure communication between the annulus and the drill string when back pressure valve 32 is closed, a bypass 36 is provided in the sidewall of drill string 10 at a point near but above back pressure valve 32. In order to monitor the pressure in annulus 24, pump 16 is periodically shut down, and the pressure in the annulus 24, which is higher than the pressure in drill string 10 due to the heavy cuttings entrained in the fluid in the annulus, is transmitted through bypass 36 and indicated at gauge 30. An abnormal condition is indicated when one reading in a series is significantly different from previous readings, and appropriate measures can be taken.

Figure 2:
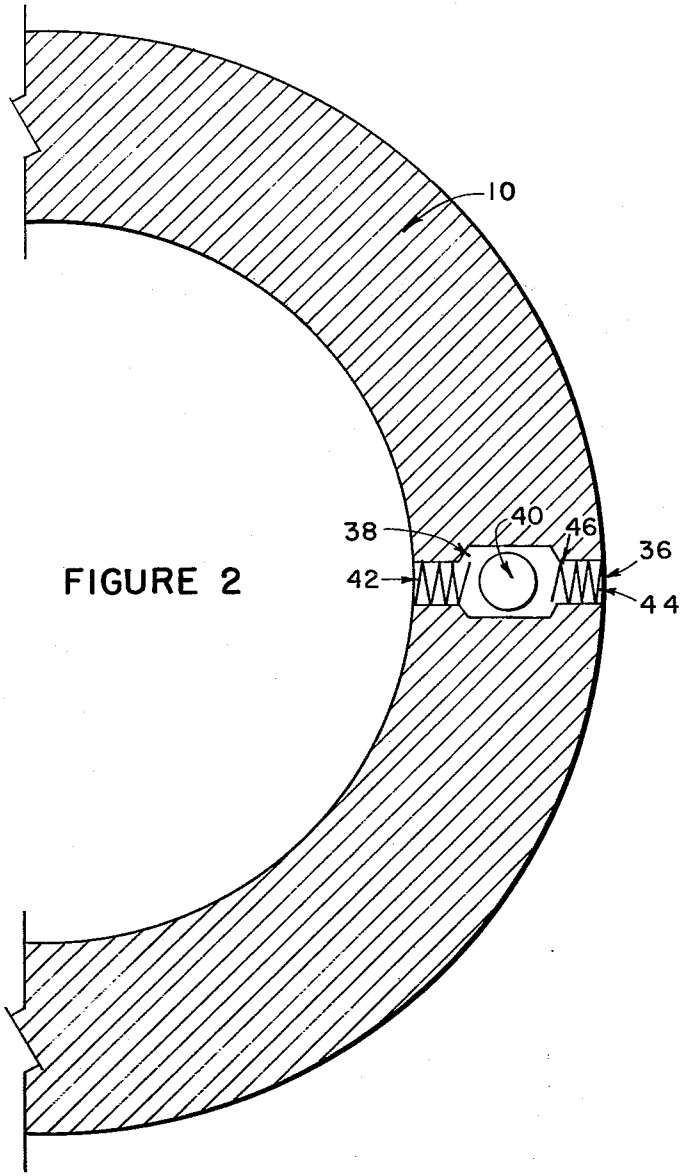
FIG. 2 is a sectional view taken along the line *a—a* in FIG. 1 depicting one embodiment of the bypass valve used in the process of this invention.

FIG. 2 shows further details of one embodiment of bypass 36 which consists of a passageway 38 through the sidewall of drill string 10. The passageway contains ball 40 in the middle thereof with two springs 42 and 44 on either side of ball 40 at the ends of passageway 38. In operation during normal drilling operations, wherein drilling mud 14 is circulated down drill string 10 and up annular space 24, ball 40 depresses spring 44 and seats against edge 46 of passageway 38 so that no flow occurs through bypass 36. When it is desired to determine the pressure in annulus 24, mud pump 16 is stopped. Ball 40 is then pushed back to the middle of passageway 38 and held there by springs 42 and 44. Fluid can now flow through bypass 36. The pressure in annulus 24 and drill string 10 equalizes and the pressure indicated by gauge 30 is the same as that in annulus 24. A comparison against pressure measurements similarly made at earlier times indicates any change in pressure. A decrease in pressure when there has been no change in the weight of drilling mud 14 indicates that formation fluids have entered borehole 2.

FIG. 3 illustrates another embodiment of bypass 36 wherein two balls 40 are used to provide a double check valve. Operation is the same as described for FIG. 2. Alternatively balls 40 could be replaced by spring-loaded cones, flapper valves, hemispheres and the like following well known apparatus designs. In all instances drill string 10 and annulus 24 will be connected via bypass 36 when there is no fluid flowing in the system.

It is seen that the present invention provides an indirect method of determining when formation fluid enters the borehole of a well being drilled by determining the pressure in the annulus between the borehole sidewall and the drill string. The formation fluids have a lower density than the drilling fluid. Thus when formation fluids enter the annulus the pressure of the column of fluid in the annulus decreases due to the contamination. This creates an even greater imbalance between the pressure of the formation fluids in the formation and the pressure in the drill string causing the formation fluids to enter the borehole at an even faster rate.

A series of calculations were made to illustrate that in a well being drilled the density of the fluid in the annulus around the drill string is normally greater than that in the drill string since the fluid in the annulus contains the cuttings cut by the drill bit from the formation being drilled. Assuming a hole depth of 10,000 feet, a drilling fluid weight of 10 pounds per gallon, a drilling fluid circulation rate of 800 gallons per minute through a 5 inch diameter drill pipe in a 12 ¼ inch diameter borehole and 18.3 gallons of cuttings drilled per minute, the density of the mud-cuttings mixture in the annulus, assuming no slip, is 10.2 pounds per gallon. Thus the pressure gradient in the annulus is 52.94 pounds per square inch per 100 feet (psi/100 ft) and that in the drill pipe is 51.90 psi/100 ft. This means the maximum differential pressure, $\Delta P$, for the 10,000 foot hole is 104 psi. Taking the same conditions as above but assuming the cuttings slip at a velocity of 4.9 feet per minute, the density of the mud-cuttings mixture in the annulus is 10.27 pounds per gallon. In this instance the pressure gradient in the drill pipe is 51.90 psi/100 ft. and that in the annulus is 53.30 psi/100 ft. The maximum $\Delta P$ for the 10,000 foot hole is 140 psi.

Entry of a gas into the annulus from the formation being drilled tends to decrease the density of the fluid in the annulus. Assuming entry into the annulus of one barrel of a gas containing 95 percent by weight methane, 3percent ethane and 2 percent propane, which is 65.20 pounds gas, into an 8 ⅝ inch diameter 10,000 foot hole containing a 5 inch diameter drill string, and through which annulus is being circulated a 10 pounds per gallon drilling fluid containing cuttings as described above, the effect of the gas on the differential pressure is as follows:

| Pressure | $\Delta P$ |
|---|---|
| 5000 psi | 17.7 |
| 4500 psi | 10.0 |
| 4000 psi | 10.8 |
| 3500 psi | 12.2 |
| 3000 psi | 14.0 |
| 2500 psi | 17.0 |
| 1250 psi | 36.4 |

Thus it is seen that entry of gas into the annulus has a pronounced effect on the pressure in the annulus, which effect can be monitored by the apparatus of this invention.

It will be understood from the foregoing discussion that various modifications of this invention will become apparent to those skilled in the art without departing from the scope and spirit of the invention. It is to be understood that the invention is not necessarily limited to the specific embodiments described.

What is claimed is:

1. A method for determining the entry of formation fluids into the borehole of a well during drilling of the well using a circulating drilling fluid and a drill string with a back pressure valve positioned near the bottom of the drill string above the drill bit comprising:

a. providing a bypass in the sidewall of the drill string above the back pressure valve, said bypass providing fluid pressure communication between the interior of the drill string and the annulus between the drill pipe and the borehole;

b. circulating drilling fluid down the drill pipe and back up said annulus during drilling thereby producing formation cuttings which are carried to the surface by said circulating fluid, said formation cuttings providing, in the absence of entry of formation fluids into the borehole, a returning circulating fluid of greater density than the density of the circulating fluid in said drill pipe;

c. stopping the circulation of drilling fluid in the borehole;

d. determining the pressure in the drill string downstream from the pump used to circulate the drilling fluid, said pressure reflecting the difference in density of circulating fluid in the borehole annulus and in the drill string; and e. comparing the so-determined pressure with previous pressure determinations made using similar steps.

2. The method of claim 1 wherein the pressure determination is made at the surface of the well.

3. The method of claim 1 wherein the bypass comprises a two-way check valve.

4. The method of claim 1 wherein the bypass remains closed when drilling fluid is being circulated in the borehole and opens when such circulation ceases.

* * * * *